United States Patent [19]

Baxter

[11] 4,145,973

[45] Mar. 27, 1979

[54] DUNNAGE BAG WITH ATTACHMENT MEANS

[75] Inventor: Robert O. Baxter, West Monroe, La.

[73] Assignee: International Paper Company, New York, N.Y.

[21] Appl. No.: 812,205

[22] Filed: Jul. 5, 1977

[51] Int. Cl.[2] ..... B65D 45/00

[52] U.S. Cl. ..... 105/468; 206/522

[58] Field of Search ..... 105/468, 496; 214/10.5 D; 206/522, 813

[56] References Cited

U.S. PATENT DOCUMENTS

| | | | |
|---|---|---|---|
| 2,674,206 | 4/1954 | Scott | 214/10.5 D |
| 2,770,411 | 11/1956 | MacKay | 206/813 X |
| 3,115,977 | 12/1963 | Mirando | 214/10.5 D |
| 3,131,648 | 5/1964 | Seger | 214/10.5 D |
| 3,139,998 | 7/1964 | Seaman | 214/10.5 D |
| 3,199,689 | 8/1965 | Feldkamp | 214/10.5 D |
| 3,427,995 | 2/1969 | Stafford | 214/10.5 D |
| 3,427,997 | 2/1969 | Brown et al. | 214/10.5 D |
| 3,847,091 | 11/1974 | Holt | 214/10.5 D X |

*Primary Examiner*—Robert G. Sheridan
*Attorney, Agent, or Firm*—Thomas L. Giannetti

[57] ABSTRACT

A dunnage bag provided with an adhesive strip for attaching the uninflated bag to the surface against which it will bear when inflated. An attachment tab which is an extension of the material of the bag itself provides a means for attaching the adhesive strip to the bag, and thus a means of attaching the bag to the surface against which it will bear when inflated.

5 Claims, 3 Drawing Figures

FIG. 2
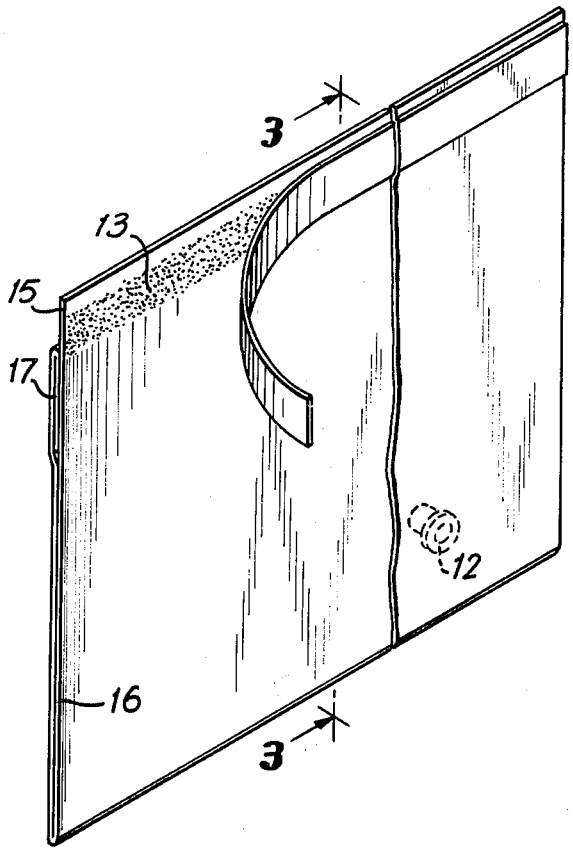
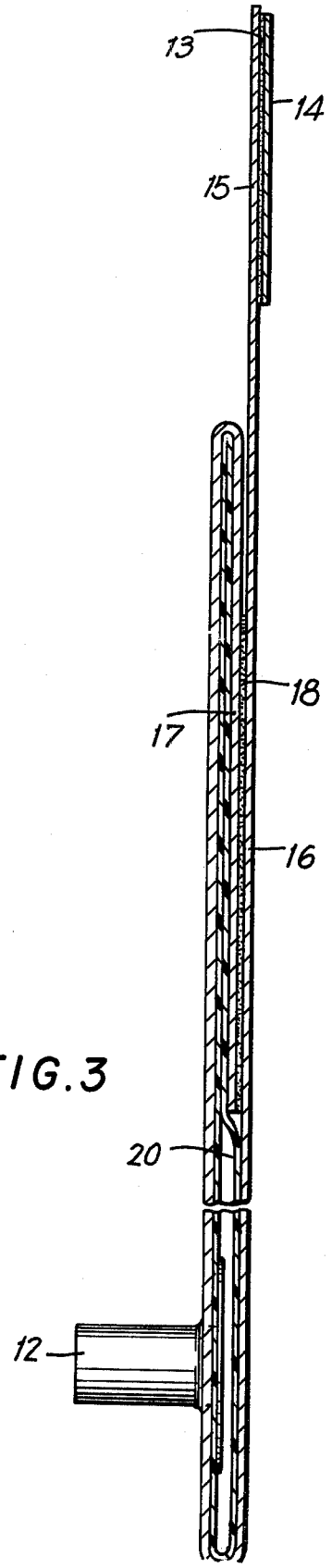
FIG. 3

DUNNAGE BAG WITH ATTACHMENT MEANS

BACKGROUND OF THE INVENTION

FIELD TO WHICH THE INVENTION PERTAINS

In transporting articles of various kinds, e.g., washing machines or other large consumer appliances, the articles are usually placed in the cargo space of a vehicle such as a railroad car. After placing the articles in the car, it is desirable to prevent them from being damaged due to their shifting or moving around during transport. Dunnage bags, large air-inflatable bags often made of paper with an air-tight plastic liner, are a means of preventing such movement, and are used by many carriers. These bags are placed between the articles to be shipped and between the articles and the walls of the cargo space and then inflated. The inflated bags provide a resilient cushion between articles and between the articles and the walls of the cargo space. At the destination, the dunnage bags are deflated and removed to facilitate unloading of the articles.

Often it is desirable to set the uninflated dunnage bags in place before the vehicle is loaded, and then to load the articles into the cargo space around the bags. The bags are then inflated to hold the load in place.

This procedure of loading around the uninflated dunnage bags permits the voids between articles and between the articles and the cargo space walls to be kept to a minimum. If the dunnage bags were to be placed in position after the vehicle was loaded, voids between the articles and between the articles and the walls of sufficient size to provide a walkway for a person positioning the bags would be required. With the bags in place before the vehicle is loaded, much smaller voids between the articles and between the articles and the cargo space walls are necessary. Thus valuable vehicle cargo space is conserved and when the bags are inflated the load is more snugly held in place if the bags are positioned before the vehicle is loaded.

In the face of rising transportation costs, disposable dunnage bags which may be deflated and discarded when the articles reach their destination are preferred. Because the disposable bags are used only once and then discarded, the art has tried to minimize their cost. Typically, the bags are constructed of inexpensive materials, e.g., paper webs or sheets encasing a bladder made from a thin thermo-plastic material. Another way in which low cost has been achieved is to provide bags in certain standard sizes which must accommodate all configurations of loads and vehicle cargo spaces. Also, because one large dunnage bag is less expensive than two smaller bags which occupy the same volume when inflated, the objective of minimizing costs has led to the use of larger bags.

Dunnage bags which are 16 feet in length are commonly used in rail freight car applications. Typically, more than one of the 16 foot long bags must be set in place and inflated to provide restraint against shifting of the load in a fully loaded freight car. These 16 foot bags are cumbersome to set in place initially, and are difficult to keep in place prior to and during inflation.

While the art has addressed itself to the attachment and placement of inflatable dunnage bags in vehicles before the vehicles are loaded, the typical arrangement is not suitable for disposable paper dunnage bags of the types which are now popular. Thus the invention disclosed herein facilitates the use of dunnage bags in vehicles which are not specially equipped with bag-supporting mechanisms. Finally it is contemplated that the invention described herein is especially suited for use with dunnage bags of various standard sizes and shapes, which can be used in different combinations to accommodate loads which vary in geometric configuration and is particularly well-suited for use with long dunnage bags which are so difficult and cumbersome to set and hold in place.

Prior Art

The prior art has generally been directed to providing attachment means for dunnage bags which require special modifications to the vehicle in which the bags are deployed, thereby decreasing flexibility in positioning the standard size bags to accommodate varying load and vehicle cargo space geometries as well as requiring expensive means for attachment. These attachment means are frequently part of the bags themselves thereby adding greatly to the cost of the bags and making them too costly to be readily disposable after one use. For example, U.S. Pat. No. 3,131,648 to Seger shows a system for supporting dunnage bags in a rail freight car comprising rails mounted in the top of the car from which hangers carrying hooks are suspended. The hooks engage eyes rigidly fastened to a bar affixed to the top of each dunnage bag, thereby suspending the bag from the top of the car.

Likewise, U.S. Pat. No. 3,427,997 to Brown, Jr., et al., shows an inflatable bulkhead for a railroad car, which uses elastic ropes attached at one end to a movable panel in the bulkhead to support pneumatic bags which are inflatable to provide cushioning. The bulkhead containing the inflatable bags can be positioned in the freight car, but an elaborate mechanism including overhead tracks mounted in the rail car and a latching mechanism in the bulkhead are required. Scott, in U.S. Pat. No. 2,674,206, teaches the supporting of an inflatable shoring device (i.e., a dunnage bag) in a rail car from rods suspended between shipping bins in the car. The rods engage metal eyelets in hanger tabs attached to the shoring devices, thereby suspending the shoring devices from the rods. As shown by Scott, these hanger tabs must be individually attached to the inflatable shoring device thus adding significantly to its cost, which is inconsistent with the goal of making the bag disposable.

In U.S. Pat. No. 3,115,977 to Mirando, inflatable cushions are supported from stationary partitions in a freight car by hooks affixed to the partition engaging eyelets provided on the cushions. In addition to being inflexible in not providing for movement of the partitions to accommodate different load configurations, the hook and eyelet arrangement shown in Mirando has the disadvantage of adding substantially to the cost of the cushion.

Likewise, U.S. Pat. No. 3,425,995 to Stafford, Jr., teaches the use of a dunnage bag in a movable bulkhead for use on a railraod flat car, and does not address the problem of filling the voids between articles in an enclosed cargo space. Moreover, the inflatable dunnage bags shown by Stafford, Jr., include metal anchor plates which must be bolted to the bulkheads, thereby adding substantially to the cost of manufacturing the bags and limiting the flexibility in placing the bags.

In summary, nothing in the prior art shows a means for providing flexible and facile dunnage bag placement to fill both the voids between the articles being transported and between the articles and the walls of the cargo space of the vehicle. Moreover, the prior methods of placing dunnage bags add substantially both to the cost of the bag itself, and to the cost of the freight car or other cargo carrier in which the bag is to be placed.

SUMMARY OF THE INVENTION

An adhesive strip is provided on a dunnage bag for holding the uninflated bag to the surface against which it will bear when the bag is inflated. The adhesive strip, in one embodiment, is affixed to an attachment tab formed from one or more plys of the material, usually paper, from which the bag is constructed.

DESCRIPTION OF THE DRAWINGS

FIG. 2 is a partial perspective view of a dunnage bag employing another preferred embodiment of the instant invention.

FIG. 3 is a cross sectional view taken along line 3—3 of FIG. 2.

DESCRIPTION OF THE PREFERRED EMBODIMENTS

Figure 1:
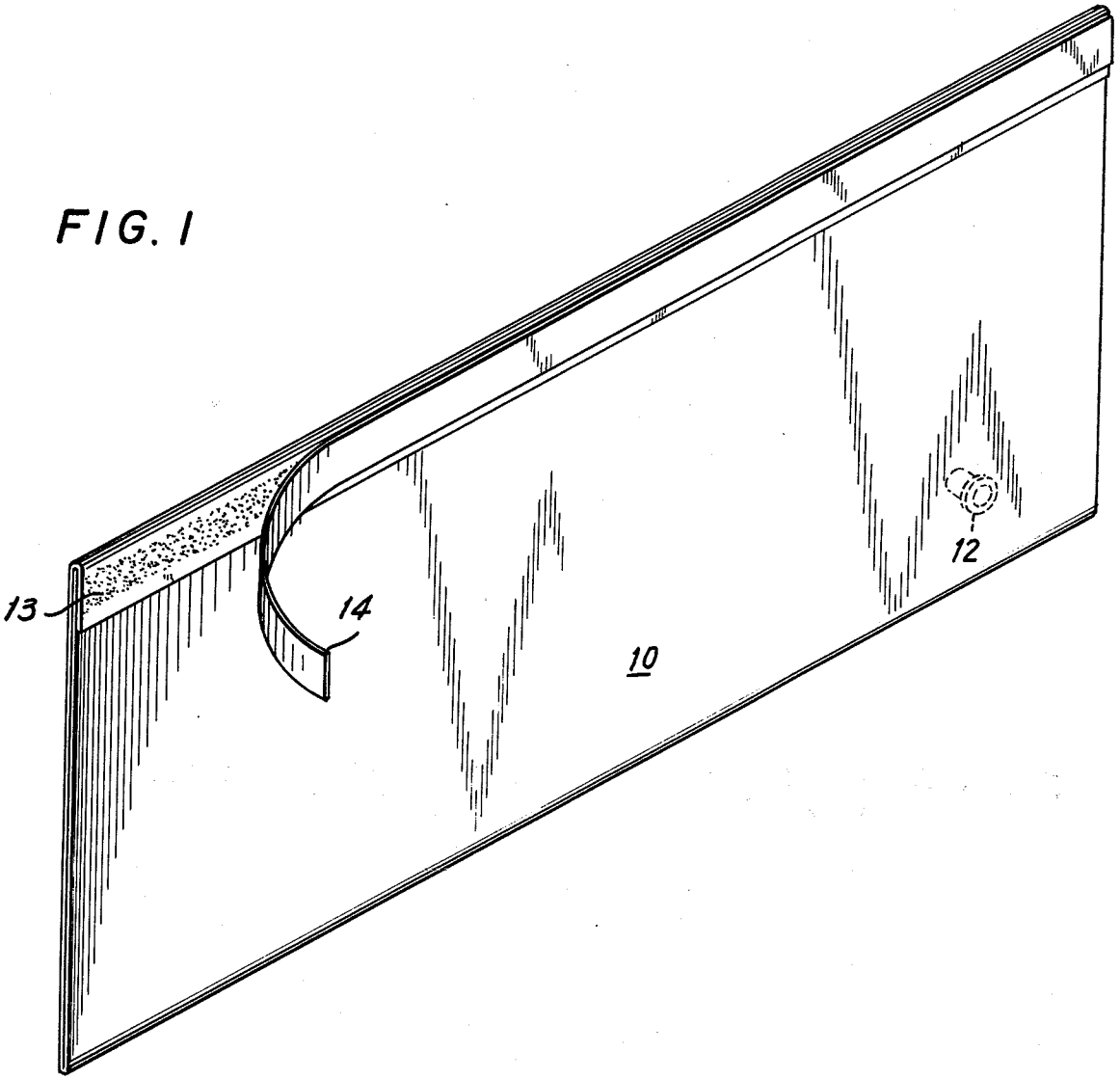
FIG. 1 is a perspective view of a dunnage bag employing a preferred embodiment of the instant invention.

Referring now to the drawings, and particularly to FIG. 1, there is shown an exemplary dunnage bag 10 illustrating my invention in one of its preferred embodiments. The bag 10 is constructed of a plurality of paper plys or webs, which envelop a bladder constructed of a thin thermoplastic material (not shown). The bag in FIG. 1 is shown in its uninflated condition. Inflation is achieved by connecting a source of pressurized air to valve 12 in the bag.

Along one edge of the bag there is provided a strip of self-adhesive material 13 such as a strip of adhesive tape. Preferably, the self-adhesive is covered by a strip of protective material 14 which prevents the adhesive material from contacting and adhering to a surface while the bag 10 is being handled prior to being set in place. Protective covering strip 14 is constructed of a material which adheres to the surface of the self-adhesive strip 13, but which can readily be removed from the strip when it is desired to affix the bag to the surface against which it will bear when inflated.

FIGS. 2–3 show another preferred embodiment of my invention. In this embodiment, the self-adhesive strip 13 is provided on a special attachment tab 15 which is constructed from one outside ply 16 of the dunnage bag. Referring now to FIG. 3, ply 16 is attached to another outside ply 17 in the manner which is conventional in dunnage bag construction, namely, by an adhesive material applied at seam 18 to affect a seal between outside plys 16 and 17. Air bladder 20, shown in FIG. 3, is inflated by connecting a source of high pressure air to valve 12, in the same manner described in conjunction with the embodiment of FIG. 1.

Alternatively, an attachment tab similar to tab 15 in FIGS. 2–3, but which is not formed from one of plys of the bag but rather is attached to the bag to permit the bag to be affixed to a surface is also contemplated and is within the spirit of this invention.

I claim:

1. An improved dunnage bag for protecting the contents of a loaded vehicle cargo space from being damaged by movements of the vehicle during transport by filling voids between the articles and between the articles and the walls of the cargo space, said dunnage bag being adapted for attachment prior to inflation to a surface against which it will bear when inflated, and for deflation and removal from the cargo space at the vehicle's destination, comprising:

(a) a substantially air-tight bladder which can be inflated from a supply of high pressure air;

(b) an outer protective covering for the bladder constructed of a plurality of plys substantially encasing the air-tight bladder;

(c) a valve in the bladder which permits the interior of the bladder to be connected to a source of high pressure air for inflation of the bladder, the valve extending through the outer protective covering; and (d) an adhesive material affixed to the outer protective covering substantially along an edge of the bag, which adhesive can be adhered against a surface to hold the uninflated bag in place while the vehicle is being loaded around the uninflated bag.

2. The improved dunnage bag of claim 1 further comprising a protective covering for the adhesive material to prevent the material from adhering to a surface before the bag is in place, the protective covering being removable when it is desired to affix the uninflated bag to a surface.

3. The improved dunnage bag of claim 1, further comprising an attachment tab located along an edge of the bag to which tab the adhesive material is affixed for adhering the uninflated bag to a surface.

4. The improved dunnage bag of claim 3 wherein the attachment tab is formed from the layers of the outer protective covering.

5. The dunnage bag of claim 1 wherein the outer protective covering of the bag is constructed of paper and an adhesive strip is affixed to the outer protective covering to hold the bag in place before it is inflated.

* * * * *

UNITED STATES PATENT AND TRADEMARK OFFICE

CERTIFICATE OF CORRECTION

PATENT NO. : 4,145,973

DATED : March 27, 1979

INVENTOR(S) : Robert O. Baxter

It is certified that error appears in the above-identified patent and that said Letters Patent are hereby corrected as shown below:

In the Application No. (page 1, line [21]), "812,205" should read -- 812,505 --.

Signed and Sealed this

*Eighteenth* Day of *September 1979*

[SEAL]

*Attest:*

*Attesting Officer*

LUTRELLE F. PARKER

*Acting Commissioner of Patents and Trademarks*